US006352029B1

(12) United States Patent
Guirguis et al.

(10) Patent No.: US 6,352,029 B1
(45) Date of Patent: Mar. 5, 2002

(54) THERMALLY ACTUATED RELEASE MECHANISM

(75) Inventors: Raafat H. Guirguis, Fairfax, VA (US); John M. Kelley, Owings Mills, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/538,501

(22) Filed: Mar. 30, 2000

(51) Int. Cl.[7] ..... C06B 45/00
(52) U.S. Cl. ..... 102/286; 102/290; 102/292
(58) Field of Search ..... 102/286, 287, 102/288, 290, 307, 306, 476, 292

(56) References Cited

U.S. PATENT DOCUMENTS 3,008,417 A * 11/1961 Keathley et al. ..... 102/287
3,718,094 A * 2/1973 Bermender ..... 102/287
4,354,884 A * 10/1982 Williams ..... 102/290 X
4,574,700 A * 3/1986 Lewis ..... 102/290 X
4,590,860 A * 5/1986 Kromrey ..... 102/290 X
4,597,994 A * 7/1986 Bolinder et al. ..... 102/290 X
4,619,201 A 10/1986 Romer et al. ..... 102/283
4,654,093 A * 3/1987 Bolinder et al. ..... 102/290 X
4,896,609 A * 1/1990 Betts et al. ..... 102/307 X
4,950,342 A * 8/1990 Canterberry ..... 102/290 X
5,249,554 A 10/1993 Tamor et al. ..... 123/90.51
5,524,544 A * 6/1996 O'Meara et al. ..... 102/291 X
5,538,795 A 7/1996 Barbee et al. ..... 428/420
5,597,974 A * 1/1997 Voreck, Jr. et al. ..... 102/307
5,712,445 A 1/1998 Kassuelke et al. ..... 102/288
5,723,811 A * 3/1998 Bouet et al. ..... 102/476
5,833,782 A 11/1998 Crane et al. ..... 156/60
5,996,501 A * 12/1999 Spencer et al. ..... 102/286

* cited by examiner

*Primary Examiner*—Peter A. Nelson
(74) *Attorney, Agent, or Firm*—Mark Homer

(57) ABSTRACT

This invention relates to explosive charges in which the chemical and physical composition changes gradually from point to point in order to accomplish differing, specific design objectives. More specifically, the invention relates to an explosive comprised by uniformly mixing components of differing chemical and physical properties in order to take advantage of the functions performed by these different components resulting in an explosive capable of performing multiple or specific tasks.

20 Claims, 4 Drawing Sheets

Multi-Mode Warhead Gradient Explosive

Multi-Mode Warhead Gradient Explosive

Axially Graded Explosive

Graded Shaped-Charges

Explosive Train Explosives

THERMALLY ACTUATED RELEASE MECHANISM

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

This invention relates to high explosives, capable of detonation, constructed by uniformly mixing components of differing chemical and physical properties in order to take advantage of the functions performed by these different components. More specifically, the invention relates to explosive charges in which the chemical and physical composition changes gradually from point to point in order to accomplish differing, specific design objectives, including performing multiple tasks equally well.

2. Description of the Related Art

Generally, an explosive charge is designed to accomplish a specific task. The particular chemical composition of the explosive is chosen from several candidates to perform the task best. If none of the candidates can alone perform the task well, several chemical compositions are uniformly mixed together in the same explosive. For example, an explosive charge mostly composed of HMX (Cyclotetramethylenetetranitramine) is good for fragmenting metal cases and driving the fragments at high velocity, but it will perform less than optimum in internal blast applications. That is because to drive fragments well, the explosive has to release a large amount of gases fast, but a good internal blast explosive has to be rich in fuels that react with the air contained inside the target, an intrinsically slow process. HMX and Al (Aluminum) particles can be uniformly mixed to create a good internal blast explosive.

Charges in which two or three different explosives are combined in a single charge or warhead have also been constructed. For example, a plane-wave generator is a charge shaped like a truncated cone the core of which is constructed of an explosive in which the detonation propagates at moderate velocity, but the outer layer is made of an explosive in which the detonation propagates at a significantly higher velocity. The angle of the cone is adjusted according to the ratio of the two detonation velocities to produce a plane or flat detonation wave profile. An example in which more than one charge are combined in the same warhead is explosive trains. For safety reasons, the main charge of a warhead has to be made of an insensitive explosive composition. In order to initiate the warhead successfully, a small detonator made of sensitive energetic material ignites a booster charge made of an explosive less sensitive than the detonator, but capable of generating large pressures capable of initiating the insensitive, hard-to-initiate main charge.

However, problems arise when combining two or more explosives into a single charge. At each interface between two different explosives, sudden changes in acoustic impedance induce reflection and refraction waves of finite amplitudes. These waves, or their reflections, can cause premature ignition, separation before successful ignition, extinction of reaction, or complicate and possibly destroy any beneficial directional effects of the explosive. Prior to this invention, no explosive has been designed so that the composition changes gradually and smoothly (at a finite gradient) from point to point in order to avoid these problems.

The use of multiple optional points when initiating spatially uniform explosive charges has been attempted. For example, multiple ignition points were added to the circumference of a cased cylindrical charge in order to determine whether it is possible to direct a higher percentage of the case fragments towards a target, rather than equally dispersing the fragments in all directions like in traditional warheads. However, when multiple optional ignition points are combined with gradient explosive technology, we can create explosive charges that perform optimally in different missions, even with conflicting requirements on the explosive composition, such as the fragmentation and internal blast requirements explained above.

SUMMARY OF THE INVENTION

The invention proposed herein comprises a gradient explosive in association with multiple optional selective ignition points. The novel concept of a gradient explosive refers to an explosive wherein the chemical and physical composition changes gradually from point to point. When an explosive of this nature is combined with multiple optional ignition points, different outcomes can be obtained from detonating the same explosive charge depending on which one of the optional ignition points is used to initiate the charge. Gradient explosives do not present the inherent problems noted above associated when combining two different explosives in the same charge because the gradual change in composition will not generate strong refraction and reflection waves of the detonation wave. Other benefits of gradient explosives not available from current explosive technology are explained below.

First, gradient explosives permit shaping of the detonation wave. The inclination of the detonation wave to the liner of a shaped-charge can be controlled to enhance performance, thereby producing faster, more stable jets. Second, warhead directional effects can be built directly into the explosive itself. Third, because gradient explosives are capable of multiple tasks as noted above, the terminal effect of the explosive can be selected en route to a target. Finally, gradient explosives can perform tasks which prior explosives were incapable of performing, or at least performing well. For example, the detrimental effects of so called corner turning, encountered when a detonation wave is axially transmitted from a smaller to a larger diameter concentric explosive charge, can be eliminated by having the comers, or shoulders of the larger charge, rich with an explosive component that can support a faster detonation wave.

Accordingly, it is the object of this invention to provide an explosive wherein the composition of the explosive changes gradually across the explosive.

It is a further object of this invention to provide an explosive capable of performing multiple, selective tasks.

BRIEF DESCRIPTION OF TIE DRAWINGS

The accompanying drawings, which are incorporated in and constitute a part of the specification, illustrate embodiments of the invention, and, together with the description, serve to explain the principles of the invention.

FIG. 3(*b*) is a different illustration of current shaped-charge explosive designed to alter the detonation wave of the explosive.

FIG. 3(*c*) is an illustration of a shaped-charge gradient explosive.

FIG. 4(*b*) is an illustration of a gradient explosive train.

DESCRIPTION OF THE PREFERRED EMBODIMENT

The invention, as embodied herein, comprises a gradient explosive capable of performing multiple tasks only feasible by separate explosive compositions, allowing the shaping of detonation waves, as well as other tasks described below that were not possible prior to this invention. The gradient explosive comprises at least two mixed materials, but instead of being uniformly mixed as in traditional explosives, their relative proportions (fraction ratio) and/or other physical characteristics (for example, particle size) gradually changes from one point to another, such that the resulting charge is capable of detonating when properly initiated, thus requiring that at least one of the materials has to be a high-explosive energetic compound. The spatial scale limiting the gradual change from one point to another neighboring point is the size of the largest particle involved in the mix.

The gradual change in composition introduces a new degree of freedom in explosive compositions that can be exploited to achieve benefits that cannot be achieved in spatially uniform explosives. For example, it was always possible to place more than one detonator in contact with a traditional uniform explosive, but the outcome of initiating the explosive at any one of these optional ignition points, even if successfully accomplished, would be almost the same, thus would not present any real benefit. However, when added to a gradient explosive, optional ignition points can provide additional benefits because the outcome of initiating the explosive will significantly change depending on which detonator is ignited, or if more than one detonator is ignited, the sequence of igniting them one after the other.

Moreover, because many of the explosives used in main charges are insensitive, they usually require a booster charge, after the detonator, to successfully initiate them, which presents a practical problem when several optional ignition points are desired. However, because gradient explosives allow the option of placing near each detonator a small region of booster explosive material as explained below, successful initiation at more than one point is not a problem.

Figure 1:
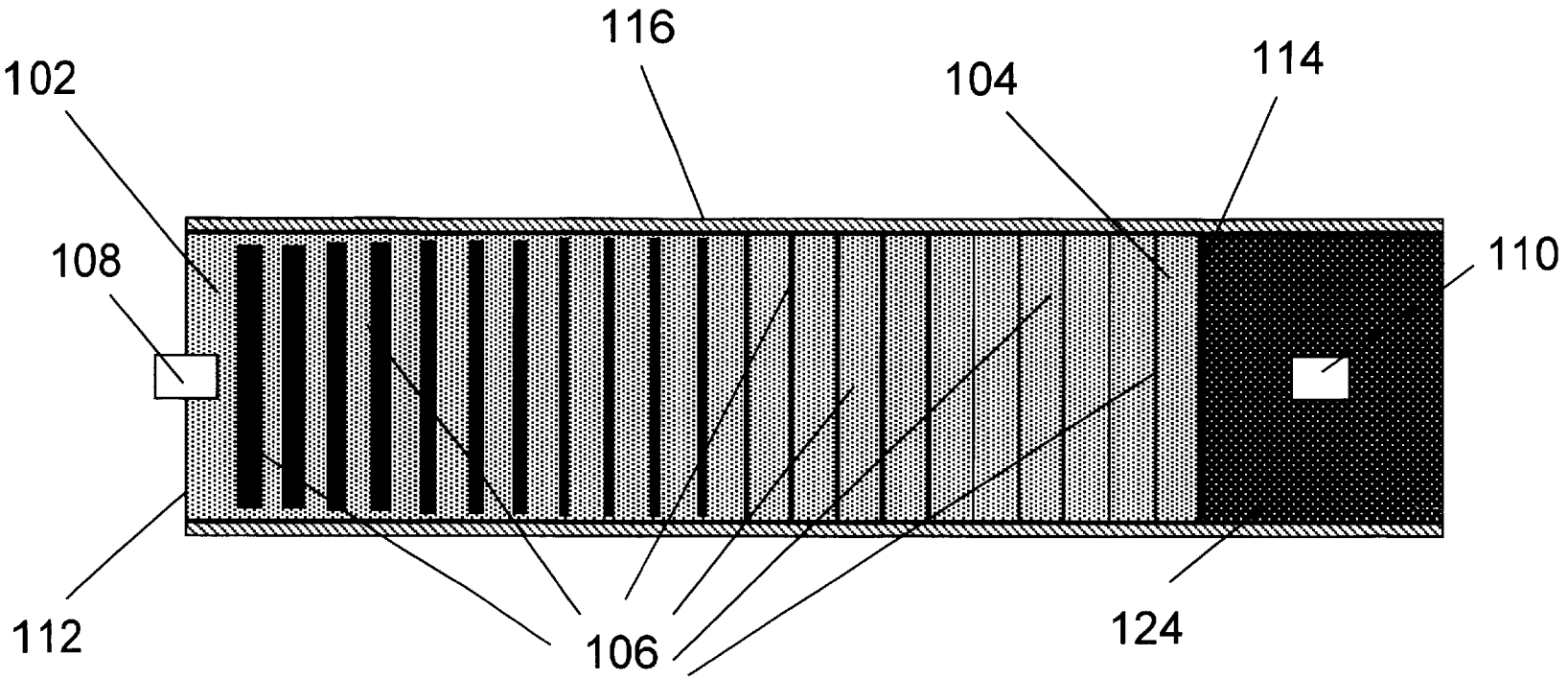
FIG. 1 is an illustration of a multi-mode warhead incorporating a gradient explosive comprising an ideal (fast-reacting) explosive and non-ideal (slow-reacting) explosive.

Referring to FIG. 1, one preferred embodiment of the gradient explosive comprises an axially graded explosive. In this embodiment, a first explosive material 102 mixed with a first mixer material 104 produces a gradient explosive wherein the explosive composition gradually changes along the axis from substantially the composition of the first explosive material 102 at the front end 112 of the explosive to substantially the composition of the first mixer material 104 at the back end 114 of the explosive. At some middle point 116, the explosive composition would comprise approximately 50% of the first explosive material 102 and 50% of the first mixer material 104. The ignition means 108 and 110 indicated in FIG. 1 are located proximate to the front end 112 and the back end 114, respectively. However, the location of the ignition means 108 and 110 merely represent a sampling of optional locations wherein other ignition points, represented by 106, can be added. The locations of these optional ignition points 106 can be selected based upon the specific explosive composition required for the mission. In this example, the first explosive material 102 is assumed sensitive enough and energetic enough such that it does not to require an additional booster charge to successfully initiate the charge using the ignition means 108. The second explosive 104 is assumed insensitive and requires a booster charge 124 to initiate it through ignition means 110.

Some examples of explosive chemical compositions that can be beneficially used as the first explosive material 102 include RDX (Cyclotrimethylenetrinitamine), HMX (Cyclotetramethylenetetranitramine), and PETN. These are fast-reacting explosive compositions that produce detonation velocities in the range 8.0 to 9.5 kilometers per second. Other potential first explosive materials 102 include AN (ammonium nitrate) and AP (ammonium perchlorate). These materials are examples of slow-reacting explosives producing detonation velocities in the range 4.5 to 6.5 kilometers per second and that are not easy to initiate. If a slow-reacting explosive is used as the mixer material 104, a booster charge 124 should be added. The booster charge 124 preferably creates a high pressure detonation, but is less sensitive than the other materials used within the explosive. Examples of booster charge 124 materials include RDX or HMX based materials with approximately 92% to 98% comprising RDX or HMX with the remainder being a binder material. Other examples of specific configurations using different materials for the first explosive material 102 and the first mixer material 104, for specific purposes, are set forth below.

Assume the first explosive material 102 is RDX or HMX. The first mixer material 104 can comprise either an explosive or non-explosive composition. The first mixer material may comprise any of the explosive compositions set forth above for the first explosive material 102 or may comprise a substantially inert material, for example a metal such as aluminum. Examples of configurations using specific first mixer materials 104 for specific purposes are set forth below.

The embodiment of the invention set forth in FIG. 1 shows two ignition means 108 and 110 wherein ignition means 108 is located at the front end 112 of the gradient explosive, proximate to the first explosive material 102 and ignition means 110 is located at the back end 114 of the gradient explosive, proximate to the first mixer material 104. Therefore, if the ignition means 108 is initiated, a detonation wave corresponding to the chemical composition of the first explosive material 102 will propagate near the front end 112, but as it propagates towards the back end 114, it will gradually change to a detonation wave corresponding to the chemical composition of the first mixing material 104. The ignition means 108 and 110 may be initiated independently or concurrently depending upon the specific mission requirements of the gradient explosive. The ignition means 108 and 110 can be initiated concurrently in order to produce varying shaped detonation waves by combining the detonation waves of the first explosive material 102 and the first mixer material 104. The ignition means 108 and 110 may comprise any device capable of initiating the explosive. Examples of ignition means 108 and 110 include detonation cords and blasting caps. In one preferred embodiment of the invention, the ignition means 108 and 110 comprise micromechanical (MEMS) actuated ignitors that can be computer controlled.

The following examples illustrate some of the possible configurations of a gradient explosives capable of accomplishing specific mission requirements.

EXAMPLE 1

Axially Graded Gradient Explosive

Figure 2:
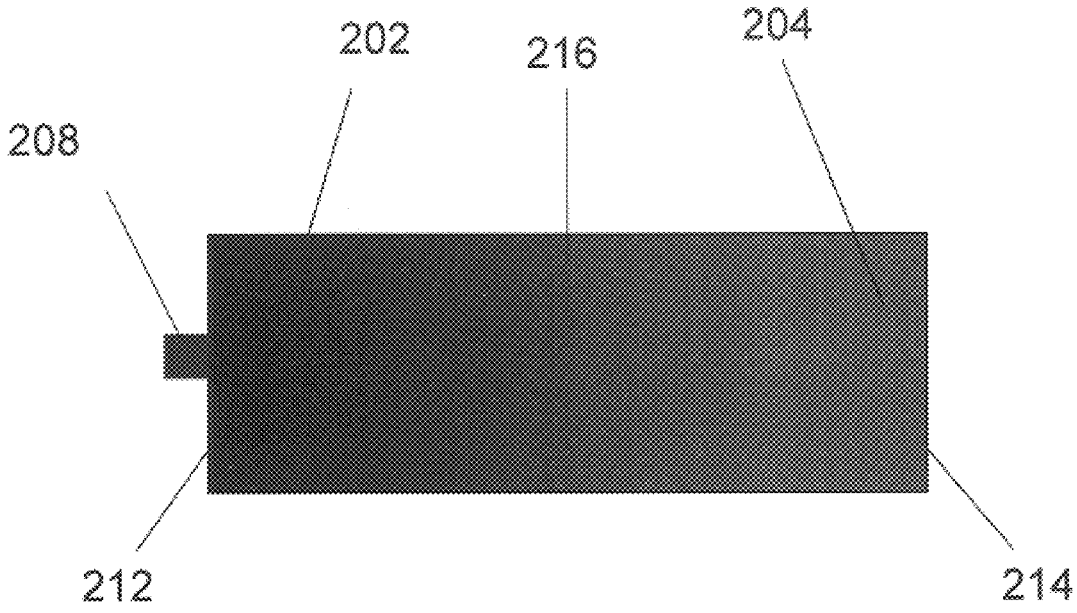
FIG. 2 is an illustration of an axially graded gradient explosive comprising one ignition means.

FIG. 2 illustrates an axially graded gradient explosive comprising one ignition means 208 located proximate to the front side 212 of the explosive. At the front side 212 of the explosive, the composition of the explosive is substantially that of the first explosive material 202. At the back side 214 of the explosive, the composition of the explosive is substantially that of the first mixer material 204. In the first example, the first explosive material 202 comprises 100% HMX and the first mixer material 204 comprises 100% AP. Because the explosive is axially graded, the composition at the approximate center of the explosive, designated 216, would be approximately 50% HMX and 50% AP. The detonation velocities of HMX and AP are 9.1 km/s and 6.0 km/s respectively. Therefore, if the ignition means 208, located proximate to an explosive composition subsantially 100% HMX, is initiated, the resultant detonation wave will slow down as it travels from the faster reacting explosive composition (100% HMX) to the slower reacting explosive composition (100% AP).

If the above example is changed so that the composition of the first mixer material 204 is 50% HMX and 50% AP, the detonation wave resulting from the ignition means 208 will, again, slow down as it travels from the first explosive material 202 to the first mixer material 205, however, it will not slow down as much because the detonation velocity of a HMX/AP mixture is greater than that of pure AP.

Inert components, such as metals, may also be used in an axially graded gradient explosive. For example, the first mixer material 204 may comprise 70% HMX and 30% aluminum (Al). Although Al powder is inert alone, particles of Al can burn in the detonation products of HMX ($H_2O$, $CO_2$, CO, etc.). A certain percentage of AP can also be substituted for some of the HMX in the above example because AP produces oxygen, which can burn Al better than the detonation products of HMX. The first mixer material 204 may also comprise 100% Al. If the first explosive material 202 were still 100% HMX, this would result in a composition of approximately 50% HMX and 50% Al at the center 216. Using this example, when the ignition means 208 is initiated, as the detonation wave travels towards the back end 214, some Al will burn with the detonation products of the HMX, but the nearly 100% Al near the back end 214 will be mostly dispersed into the surrounding environment. One application for this type of configuration is a warhead for an internal blast where the dispersed Al will burn in the air contained within the target.

The composition of the first explosive material 202 and the first mixer material 204 does not have to be a mixture of two powders. For example, the first explosive material 202 may comprise 100% TNT and the first mixer material 204 may comprise 50% TNT and 50% HMX. The detonation velocity of TNT is 6.9 km/s. TNT melts at a low temperature and is used as an energetic binder, wherein crystals of HMX can be added to the melted TNT and the mix solidifies upon cooling in order to produce this composition of the first mixer material 204. Under these conditions, if the ignition means 208 is initiated, the detonation wave will speed up when travelling from the front end 212 to the back end 214 because the first mixer material 204will have a higher detonation velocity than the first explosive material 202.

The explosive properties of an axially graded gradient explosive may also be manipulated by changing the size of the particles comprised in the explosive composition. The critical diameter of an explosive, below which the detonation cannot propagate, decreases as the size of the particles of the explosive composition decreases. However, fine particles are more difficult to initiate than coarse particles. For example, assume first explosive material 202 comprises 100% coarse HMX and first mixer material 204 comprises 100% fine HMX. Also assume the diameter of the explosive is larger than the critical diameter for the composition at the back end 214, but less than the critical diameter for the composition at the front end 212. If the ignition means 208 is initiated, the gradient will sustain the detonation wave created by the easier to initiate course particles until the wave reaches the fine particles.

EXAMPLE 2

Shaped Charge Gradient Explosives

Figure 3:
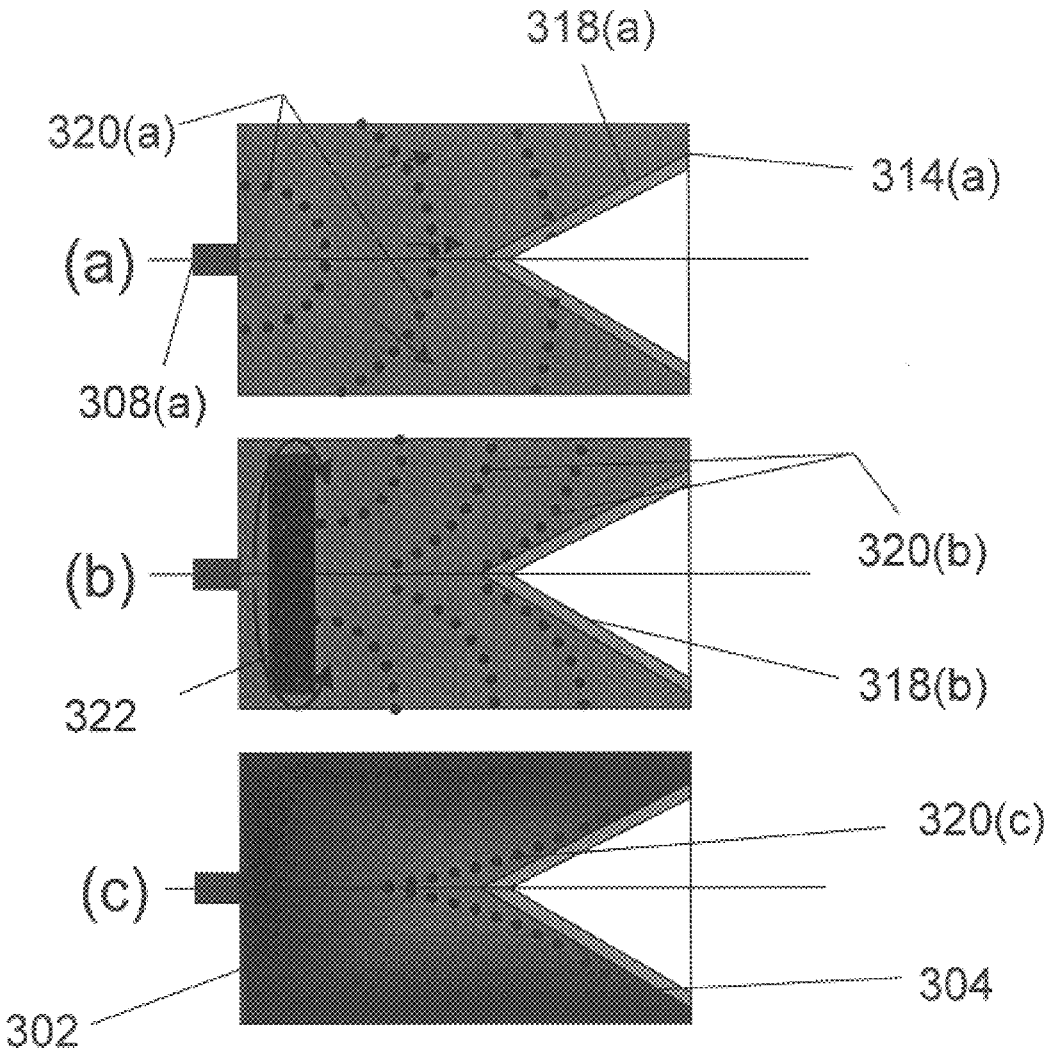
FIG. 3(*a*) is an illustration of a current shaped-charge explosive.

FIG. 3 demonstrates how gradient explosives can be used to enhance the performance of a shaped-charge. As can be seen in FIG. 3(*a*), a shaped-charge is basically an axial explosive comprising a conical-shaped liner 318(*a*) formed within the back end 314(*a*) of the explosive. If the ignition means 308(*a*) are initiated, the detonation wave 320(*a*) is nearly spherical and contacts the liner 318(*a*) in an almost perpendicular manner. FIG. 3(*b*) illustrates the current method used to solve this problem. A heavy metal disc 322 is inserted in the path of the detonation wave 320(*b*), which forces the detonation wave 320(*b*) to go around the metal disc 322. This results in the detonation wave 320(*b*) being closer in shape to the liner 318(*b*). FIG. 3(*c*) illustrates how a gradient explosive can produce a better detonation wave 320(*c*) profile. This embodiment of the invention comprises a first explosive material 302 that possesses an extremely high detonation velocity and a first mixer material 304 that possesses an extremely low detonation velocity, graded axially and radially to produce the detonation wave 320(*c*) profile shown in FIG. 3(*c*).

EXAMPLE 3

Explosive Train Gradient Explosives

Figure 4:
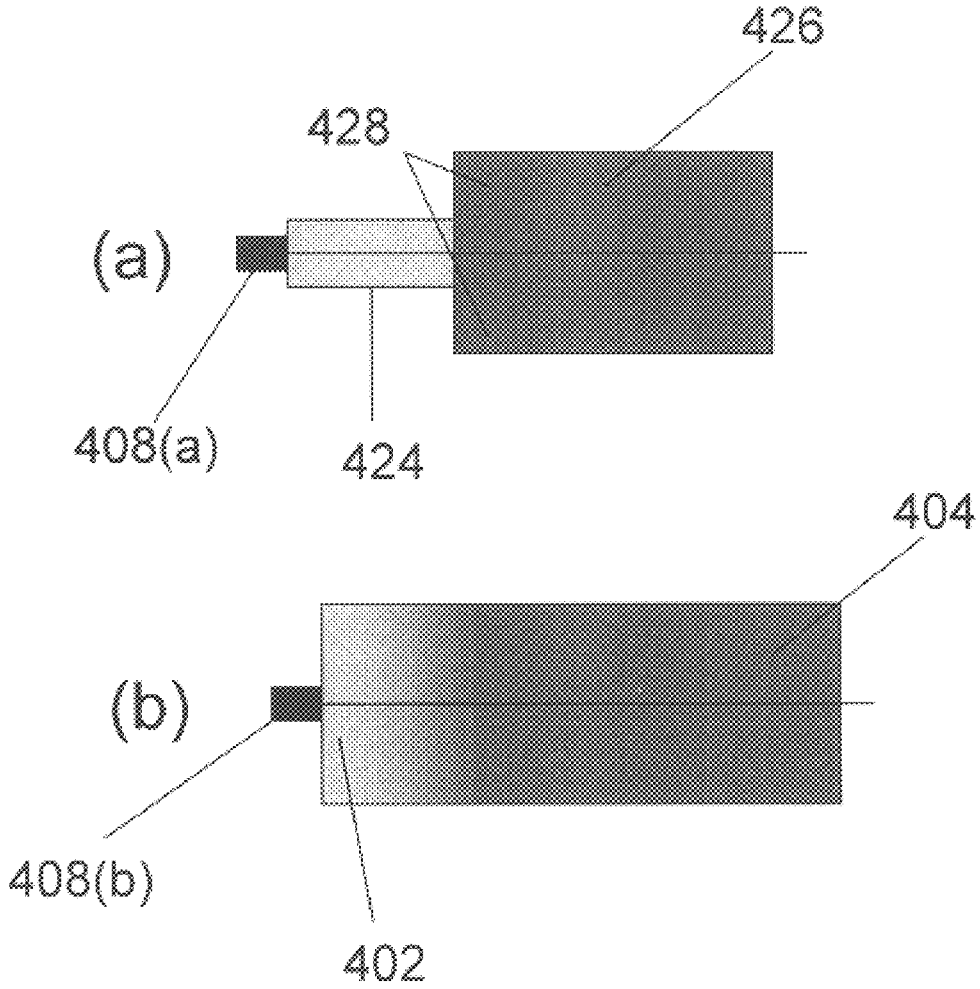
FIG. 4(*a*) is an illustration of a current explosive train.

FIG. 4 illustrates how a gradient explosive can be used to enhance the performance of an explosive train. For safety reasons, the main charge of a warhead is usually made of an insensitive explosive. In order to initiate the warhead successfully, the design set forth in FIG. 4(*a*) is commonly used. The ignition means 408(*a*) comprises a sensitive energetic material that is easy to ignite. The ignition means 408(*a*) is attached to a booster charge 424 comprising an explosive less sensitive than the ignition means, but capable of generating large pressures in order to initiate the insensitive, main charge 426. However, because of the booster charge 424 having a smaller diameter than the main charge 426, the detonation wave resulting from the booster charge cannot "turn" and contact the two comers, represented by 428, therefore, extinguishing the charge. The gradient explosive set forth in FIG. 4(*b*) can solve this problem. In this embodiment of the invention, the first explosive material 402 comprises booster charge material and the first mixing material 404 comprises main charge main charge material. The two are graded into one explosive charge wherein the ignition means 408(*b*) is placed proximate to the first explosive material 402.

What is claimed is:

1. A gradient explosive, comprising:

at least a first explosive material; and, at least a first mixer material, being explosive or non-explosive, mixed with the first explosive material to create a mixture having an explosive composition, capable of detonation, having a plurality of points proximate to each other throughout the mixture, wherein the explosive composition changes gradually from point to proximate point and each point corresponds to a different explosive composition.

2. The gradient explosive of claim 1, further comprising a plurality of ignition points corresponding to the plurality of points wherein the plurality of ignition points correspond to a different explosive composition.

3. The gradient explosive of claim 2, further comprising means to ignite at least one of the plurality of ignition points.

4. The gradient explosive of claim 3, wherein the first explosive material comprises a fast-reacting explosive material.

5. The gradient explosive of claim 4, wherein the first mixing material comprises a slow-reacting explosive material.

6. The gradient explosive of claim 5, after comprising:

a front end of the gradient explosive; and, a back end of the gradient explosive opposite the front end wherein the explosive composition at the front end comprises primarily the fast-reacting explosive material and the explosive composition of the gradient explosive gradually changes axially so that the explosive composition at the back end comprises primarily the slow-reacting explosive material.

7. The gradient explosive of claim 6, wherein the ignition means comprise locations proximate to the front end and proximate to the back end.

8. The gradient explosive of claim 4, wherein the first mixing material comprises a substantially inert material.

9. The gradient explosive of claim 8, further comprising:

a front end of the gradient explosive; and, a back end of the gradient explosive opposite the front end wherein the explosive composition at the front end comprises primarily the fast-reacting explosive material and the explosive composition of the gradient explosive gradually changes axially so that the explosive composition at the back end comprises primarily the substantially inert material.

10. The gradient explosive of claim 9, wherein the ignition means comprise locations proximate to the front end and proximate to the back end.

11. The gradient explosive of claim 7, wherein the fast-reacting explosive material comprises an RDX based explosive.

12. The gradient explosive of claim 7, wherein the fast-reacting explosive material comprises an ammonium perchlorate based explosive.

13. The gradient explosive of claim 7, wherein the slow-reacting explosive material comprises a TNT based explosive.

14. The gradient explosive of claim 7, further comprising a booster explosive material proximate to the back end wherein the ignition means comprises a location within the booster explosive.

15. The gradient explosive of claim 10, wherein the fast-reacting explosive material comprises an RDX based explosive and the substantially inert material comprises aluminum.

16. The gradient explosive of claim 3, wherein the first explosive material comprises a booster material, the first mixing material comprises a fast-reacting explosive, and the ignition means comprises a location proximate to an explosive composition substantially comprising the first explosive material.

17. The gradient explosive of claim 3, wherein the mixture comprises grading wherein ignition of the mixture results in a detonation wave having a selected shape.

18. The gradient explosive of claim 17, further comprising a liner having an approximately conical shape proximate to the back end and the ignition means comprises a location proximate to the first explosive material wherein initiation of the ignition means results in a detonation wave that approximately corresponds to the approximately conical shape of the liner.

19. A gradient explosive mixture that gradually changes composition across the mixture, produced from the step of:

mixing at least a first explosive material, and, at least a first mixer material, being explosive or non-explosive, mixed with the first explosive material to create a mixture having an explosive composition, capable of detonation, having of a plurality of points proximate to each other throughout the mixture, wherein the explosive composition changes gradually from point to proximate point and each point corresponds to a different explosive composition.

20. A method of shaping a detonation wave from an explosive, comprising the steps of:

mixing at least a first explosive material, and, at least a first mixer material, being explosive or non-explosive, mixed with the first explosive material to create a mixture having an explosive composition, capable of detonation, having a plurality of points proximate to each other throughout the mixture, wherein the explosive composition changes gradually from point to proximate point and each point corresponds to a different explosive composition;

grading the mixture wherein ignition of the mixture results in a detonation wave of a selected shape; and, igniting the mixture.

* * * * *

UNITED STATES PATENT AND TRADEMARK OFFICE

CERTIFICATE OF CORRECTION

PATENT NO. : 6,352,029 B1 
DATED : March 5, 2002
INVENTOR(S) : Raafat H. Guirguis and John M. Kelley It is certified that error appears in the above-identified patent and that said Letters Patent is hereby corrected as shown below:

Title page,
Item [54], "THERMALLY ACTUATED RELEASE MECHANISM" with the title -- GRADIENT EXPLOSIVES. --.

Signed and Sealed this

Thirteenth Day of August, 2002

*Attest:*

*Attesting Officer*

JAMES E. ROGAN
*Director of the United States Patent and Trademark Office*